US012564754B2

(12) United States Patent
Yang

(10) Patent No.: US 12,564,754 B2
(45) Date of Patent: Mar. 3, 2026

(54) PLUG-IN WEIGHTED DUMBBELL

(71) Applicant: Shandong Aochuang fitness equipment Co., LTD, Dezhou (CN)

(72) Inventor: Chunyu Yang, Dezhou (CN)

(73) Assignee: Shandong Aochuang fitness equipment Co., LTD, Dezhou (CN)

( * ) Notice: Subject to any disclaimer, the term of this patent is extended or adjusted under 35 U.S.C. 154(b) by 26 days.

(21) Appl. No.: 18/624,183

(22) Filed: Apr. 2, 2024

(65) Prior Publication Data

US 2025/0303220 A1 Oct. 2, 2025

(51) Int. Cl.
*A63B 21/072* (2006.01)
*A63B 21/075* (2006.01)

(52) U.S. Cl.
CPC ..... *A63B 21/0726* (2013.01); *A63B 21/0728* (2013.01); *A63B 21/075* (2013.01)

(58) Field of Classification Search
CPC ..... A63B 21/0726; A63B 21/0728; A63B 21/075; A63B 21/072–075
See application file for complete search history.

(56) References Cited

U.S. PATENT DOCUMENTS 6,039,678 A * 3/2000 Dawson ..... A63B 21/0728 482/107
7,182,716 B1 * 2/2007 Dawson ..... A63B 21/072 482/107
7,207,929 B2 * 4/2007 Hamilton ..... A63B 21/072 482/106
12,115,407 B1 * 10/2024 Norris ..... A63B 21/075
2001/0049324 A1 * 12/2001 Wallace ..... A63B 21/0783 482/106
2011/0021327 A1 * 1/2011 Lien ..... A63B 21/0728 482/107

(Continued)

FOREIGN PATENT DOCUMENTS

CN 107469276 A 12/2017
CN 111467735 A 7/2020

(Continued)

OTHER PUBLICATIONS

Translation of KR-20230132399-A (Year: 2023).*
Translation of KR-20180033775-A (Year: 2018).*

*Primary Examiner* — Loan B Jimenez
*Assistant Examiner* — Catrina A Letterman
(74) *Attorney, Agent, or Firm* — Bayramoglu Law Offices LLC

(57) ABSTRACT

A plug-in weighted dumbbell relates to the technical field of fitness equipment. The plug-in weighted dumbbell includes a dumbbell bar and dumbbell plates, wherein radial plug-in grooves are formed on the dumbbell plates; the dumbbell bar includes a gripping part and adjusting parts, with the adjusting parts in threaded connection with the gripping part; a screwing part is provided at one end of each of the adjusting parts distal to the gripping part; the dumbbell plates are detachably provided on the adjusting parts through the radial plug-in grooves, and two fixed dumbbell plates are fixedly connected to the gripping part, with the fixed dumbbell plates being used to limit the position of the dumbbell plates. Through the configuration of the plug-in weighted dumbbell, the dumbbell plates can be replaced more conveniently and quickly.

7 Claims, 2 Drawing Sheets

(56) References Cited

U.S. PATENT DOCUMENTS

| | | | | |
|---|---|---|---|---|
| 2017/0282003 | A1* | 10/2017 | Giafardino | A63B 15/00 |
| 2024/0157188 | A1* | 5/2024 | Chiang | A63B 21/0728 |

FOREIGN PATENT DOCUMENTS

| | | | | | |
|---|---|---|---|---|---|
| CN | 217139101 | U | | 8/2022 | |
| KR | 20180033775 | A | * | 4/2018 | A63B 23/03508 |
| KR | 20230132399 | A | * | 9/2023 | A63B 21/0726 |

* cited by examiner

PLUG-IN WEIGHTED DUMBBELL

TECHNICAL FIELD

The present invention relates to the technical field of fitness equipment, in particular to a plug-in weighted dumbbell.

BACKGROUND

Among the existing fitness equipment, dumbbells are the most commonly used equipment for exercising arm strength. At present, to adjust the use weight of dumbbells, detachable adjustment is usually adopted to achieve the addition or reduction of the dumbbell plates. The more common way now involves a plug-in or a twisting method to replace the dumbbell plates. However, the two methods for replacing dumbbells have technical defects, which are specifically as follows:

1. In the case of the plug-in method, exemplified by the dumbbell structure with Publication No. CN217139101U, a lock catch clamping structure is required to be provided on dumbbell plates during the plugging-in. Such a structure is complex, resulting in an increased unit price of the product, which is not conducive to commercial promotion.

2. In the case that the twisting method is adopted to adjust the weight of the dumbbell, a center hole is formed on each weight plate for the traditional dumbbell. When the weight needs to be adjusted, the adjusting nuts on the two sides need to be completely unscrewed from the handle, then the dumbbell plates are added or reduced before the adjusting nuts on the two sides are screwed in to lock. The operation is time-consuming and labor-consuming. Additionally, there is no connection between the adjacent weight plates, resulting in noise during use due to collisions between adjacent weight plates.

Aiming at the defects in the prior art, as a development and design company of fitness equipment, the technical problem to be solved at present is how to adjust the product structure according to the existing adjustable-weight dumbbell structure and simply the operation without increasing structural complexity, so that the replacement of dumbbell plates is more convenient and quicker.

SUMMARY

The present invention aims to solve the defects in the prior art and provides a plug-in weighted dumbbell.

In order to achieve the above objective, the present invention adopts the following technical solutions:

Provided is a plug-in weighted dumbbell, including a dumbbell bar and dumbbell plates, wherein radial plug-in grooves are formed on the dumbbell plates; the dumbbell bar includes a gripping part and adjusting parts, with the adjusting parts in threaded connection with the gripping part; a screwing part is provided at one end of each of the adjusting parts distal to the gripping part; the dumbbell plates are detachably provided on the adjusting parts through the radial plug-in grooves, and two fixed dumbbell plates are fixedly connected to the gripping part, with the fixed dumbbell plates being used to limit the position of the dumbbell plates.

Further, a plurality of the dumbbell plates are provided on the adjusting parts in a plug-in manner; the screwing parts are used for fixing the dumbbell plates on the outermost side, and the fixed dumbbell plates are used for fixing the dumbbell plates on the innermost side.

Further, through holes are formed on the dumbbell plates, and each of the through holes has a two-segment structure, with one segment being a threaded hole and the other segment being a blind hole; the threaded hole is detachably provided with a positioning bolt, and the blind hole is used as a plug-in groove; a nut on the positioning bolt is used as a plug-in protrusion to be axially plugged in and matched with the blind hole.

Furthermore, the dumbbell plate is provided with at least two through holes and two positioning bolts, and the blind holes are formed on one side distal to the gripping part; the blind holes are formed on the fixed dumbbell plate.

Further, knurls are formed on both the gripping part and the screwing parts.

Further, a carrying hole is formed on the dumbbell plate, a convenient removal groove is formed above the carrying hole, and the convenient removal grooves on two adjacent dumbbell plates form a convenient removal hole.

Further, the adjusting parts include sleeve pipes, and the sleeve pipes are fixedly connected to both ends of the gripping part; several second insertion plates are provided on an outer wall of the sleeve pipe and a screw rod is internally and threadedly connected to the sleeve pipe; an end of the screw rod is fixedly connected to the screwing part; one end of the screw rod close to the screwing part is a plain shaft, a rotating disc is provided on the plain shaft, and several first insertion plates are provided on the rotating disc; the first insertion plate matches a gap between two adjacent second insertion plates.

Furthermore, the first insertion plates and the second insertion plates are both arc-shaped plates; an arc-shaped transition is provided at an edge of one end of the first insertion plate distal to the rotating disc, and an arc-shaped transition is provided at an edge of one end of the second insertion plate close to the rotating disc.

Beneficial Effects

Compared with the prior art, the present invention has the following beneficial effects: A radial plug-in groove is formed on the dumbbell plate, and threaded holes and blind holes are coaxially formed on the two side surfaces of the dumbbell plate, with the blind hole being used as a plug-in groove. After twisting a screw into the threaded hole, the nut is used as the plug-in protrusion to be axially plugged in and matched with the blind hole, so that the rapid installation and fixation of the dumbbell plate are achieved. The first insertion plate is aligned to the gap between the second insertion plates by rotating the rotating disc, and the first insertion plate is inserted into the gap. The connecting portion of the two types of insertion plates forms a circular structure, and at this point, the rotation of the rotating disc is restricted from further rotation. The screw rod in the adjusting part is then twisted into the sleeve pipe, allowing them to be connected. The adjusting part is adjusted to a proper length before the dumbbell plates are installed. The dumbbell plates are directly inserted into the gripping part. Upon completing the insertion, the screwing part is then controlled to tightly attach to the dumbbell plates, fixing the dumbbell plates. When the number of the dumbbell plates needs to be adjusted, only the screwing part needs to be rotated to extend or shorten the length of the adjusting part. By providing such a structure, the length of the adjusting part can be adjusted at will to accommodate multiple dumbbell plates.

BRIEF DESCRIPTION OF THE DRAWINGS

The accompanying drawings, which are included to provide a further understanding of the present invention and constitute a part of this specification, are used to explain the present invention together with the embodiments of the present invention, and do not constitute a limitation to the present invention.

In the figures: 1. dumbbell plate; 2. screwing part; 3. convenient removal hole; 4. gripping part; 5. through hole; 6. positioning bolt; 7. carrying hole; 8. convenient removal groove; 9. radial plug-in groove; 10. screw rod; 11. first insertion plate; 12. sleeve pipe; 13. second insertion plate; 14. adjusting part; 15. plain shaft; 16. first arc-shaped transition; 17. second arc-shaped transition; 18. nut; 19. blind hole; and 20. knurls.

DETAILED DESCRIPTION OF THE EMBODIMENTS

The technical solutions in the embodiments of the present invention will be clearly and completely described below with reference to the accompanying drawings in the embodiments of the present invention, and it is obvious that the described embodiments are only a part of the embodiments of the present invention but not all of them.

In the description of the present invention, it should be understood that directional or positional relationships indicated by terms such as "upper", "lower", "front", "rear", "left", "right", "top", "bottom", "in", "out", and the like are based on the direction or position shown in the accompanying drawings. They are merely intended to facilitate and simplify description rather than indicate or imply that the indicated device or element must have a specific direction and be structured and operated according to the specific direction, and therefore should not be construed as limiting the present invention.

Figure 1:
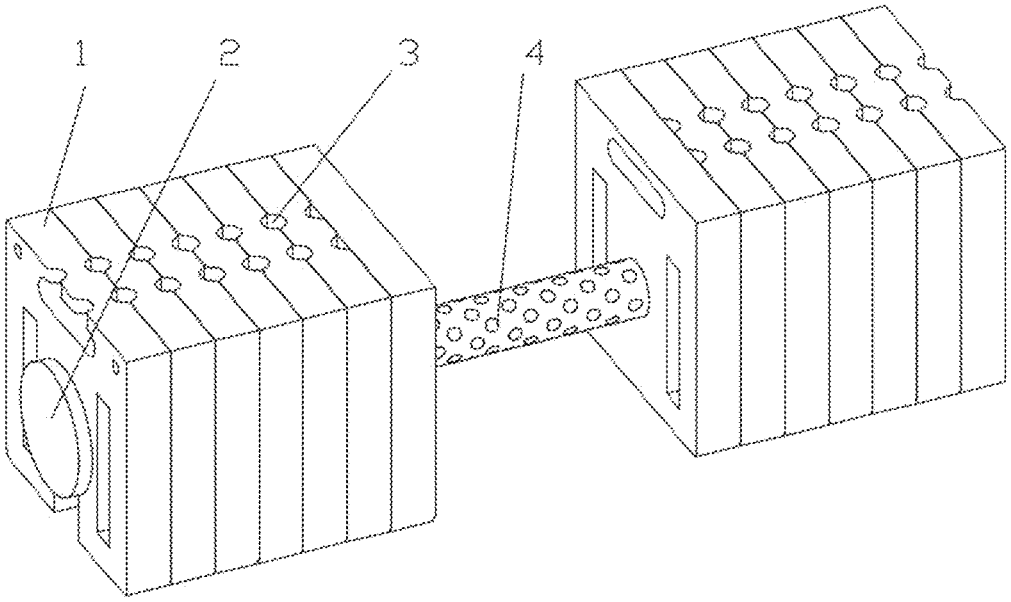
FIG. 1 is a schematic diagram of the overall structure of a plug-in weighted dumbbell.
Figure 2:
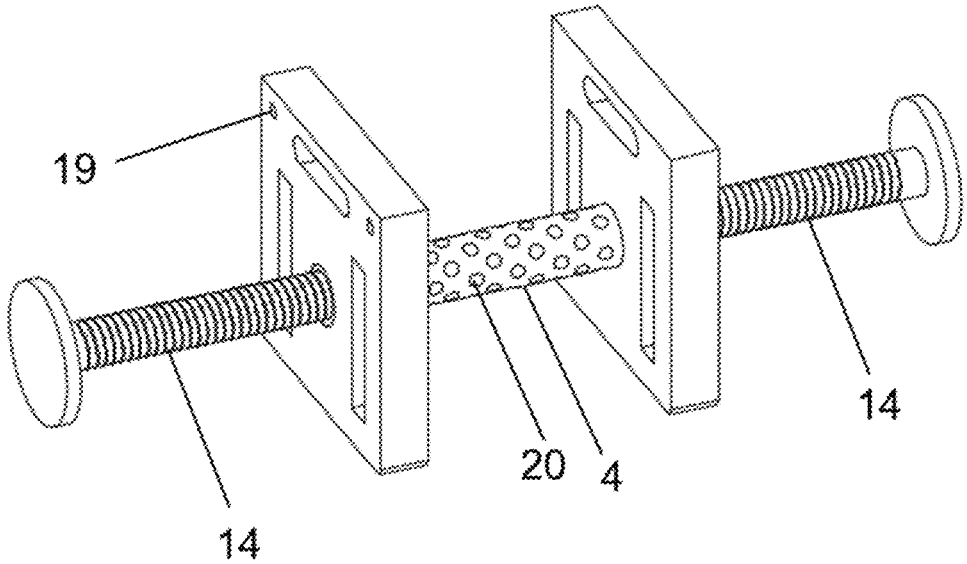
FIG. 2 is a schematic structural diagram of a dumbbell bar according to Embodiment 1.
Figure 3:
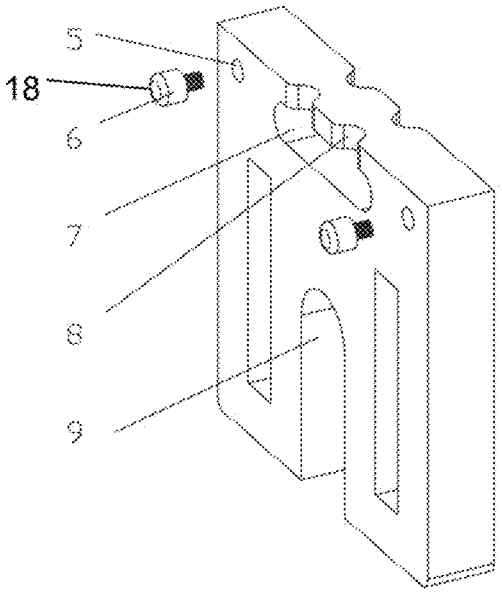
FIG. 3 is a schematic structural diagram of a dumbbell plate.

Embodiment 1: With Reference to FIGS. 1 to 3

Provided is a plug-in weighted dumbbell, including a dumbbell bar and dumbbell plates. Radial plug-in grooves are formed on the dumbbell plates. The dumbbell bar includes a gripping part and adjusting parts 14, with the adjusting parts 14 in threaded connection with the gripping part. A screwing part is provided at one end of each adjusting part 14 distal to the gripping part. The dumbbell plates are detachably provided on the adjusting parts 14 through the radial plug-in grooves, and two fixed dumbbell plates are fixedly connected to the gripping part, with the fixed dumbbell plates being used to limit the position of the dumbbell plates. The adjusting parts 14 are directly inserted into the gripping part, and the dumbbell plates are supported by the adjusting parts 14, where the fixed dumbbell plates are positioned at the edge of the gripping part.

In other preferred embodiments, the two fixed dumbbell plates are fixedly connected to the gripping part 4, and the fixed dumbbell plates are used to limit the position of the dumbbell plate 1. The structure of the fixed dumbbell plates should be similar to that of the dumbbell plates 1, and the fixed dumbbell plate can be placed on a flat surface before installing the dumbbell plates 1 to provide support for the dumbbell bar, ensuring stability when the dumbbell plates 1 are inserted downwards.

Radial plug-in grooves 9 are formed on the dumbbell plates 1, the adjusting parts 14 are provided with a plurality of dumbbell plates 1 in a plug-in manner. The screwing parts 2 are used for fixing the dumbbell plates 1 on the outermost side, and the fixed dumbbell plates are used for fixing the dumbbell plates 1 on the innermost side. The friction force between the dumbbell plates 1 can be increased through the coordination of the screwing parts 2 and the fixed dumbbell plates, so that the fixing effect of the dumbbell plates 1 is improved.

Specifically, the through hole 5 has a two-segment structure, with one segment being a threaded hole and the other segment being a blind hole. The threaded hole is detachably provided with a positioning bolt 6, and the blind hole is used as a plug-in groove. The nut 18 on the positioning bolt 6 is used as a plug-in protrusion to be axially plugged in and matched with the blind hole. When in use, the screw rod portion of the positioning bolt 6 is installed in the threaded hole, forming a structure of plug-in protrusion on the dumbbell plate 1. The nut 18 is then aligned to the blind hole, and the dumbbell plates 1 are installed in sequence.

Furthermore, the dumbbell plate 1 is provided with at least two through holes 5 and two positioning bolts 6, and the blind holes are formed on one side distal to the gripping part 4; the blind holes 19 are formed on the fixed dumbbell plates 1.

In other preferred embodiments, knurls 20 are formed on both the gripping part 4 and the screwing parts 2. The knurling can improve the friction force between the gripping part 4 and the screwing parts 2, facilitating gripping and screwing.

In other preferred embodiments, a carrying hole 7 is formed on the dumbbell plate 1, a convenient removal groove 8 is formed above the carrying hole 7, and the convenient removal grooves 8 on two adjacent dumbbell plates 1 form a convenient removal hole 3. The carrying hole 7 is formed for easy handling of the dumbbell plate 1, and the convenient removal groove 8 is formed for fingers to reach into the carrying hole 7 when detaching the dumbbell plate 1.

Figure 4:
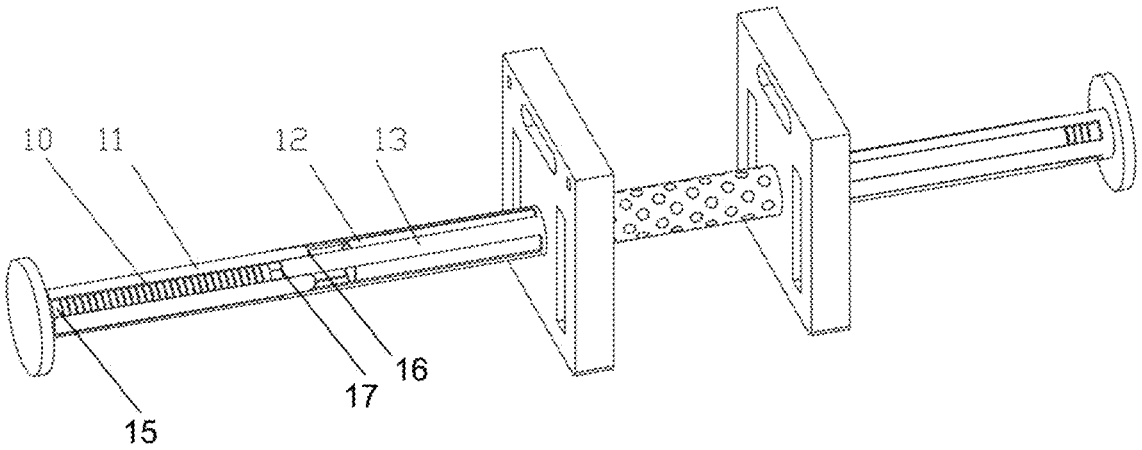
FIG. 4 is a schematic structural diagram of a dumbbell bar according to Embodiment 2.

Embodiment 2: With Reference to FIG. 4

Differing from Embodiment 1, provided is a plug-in weighted dumbbell, including a dumbbell bar and dumbbell plates 1. Radial plug-in grooves 9 are formed on the dumbbell plates 1. The dumbbell bar includes a gripping part 4 and adjusting parts 14. The dumbbell plates 1 are detachably provided on the adjusting parts 14 through the radial plug-in grooves 9. The adjusting parts 14 include sleeve pipes 12, and the sleeve pipes 12 are fixedly connected to both ends of the gripping part 4, with several second insertion plates 13 provided on the outer wall of the sleeve pipe 12 and a screw rod 10 internally and threadedly connected to the sleeve pipe 12. The end of the screw rod 10 is fixedly connected to a screwing part 2. One end of the screw rod 10 close to the screwing part 2 is a plain shaft 15, a rotating disc is provided on the plain shaft 15, and several first insertion plates 11 are provided on the rotating disc. The first insertion plate 11 matches the gap between two adjacent second insertion plates 13.

In other preferred embodiments, the first insertion plates 11 and the second insertion plates 13 are both arc-shaped plates. An arc-shaped transition 16 is provided at the edge of one end of the first insertion plate 11 distal to the rotating disc, and an arc-shaped transition 17 is provided at the edge of one end of the second insertion plate 13 close to the rotating disc. End parts of the two types of insertion plates are provided with arc-shaped transitions 16/17 so as to insert the first insertion plate 11 into the second insertion plate 13. The two types of insertion plates are both arc-shaped plates and form a circular sleeve structure after matching so as to support the dumbbell plates 1.

When in use, the first insertion plate 11 is aligned to the gap between the second insertion plates 13 by rotating the rotating disc, and the first insertion plate 11 is inserted into the gap. The connecting portion of the two types of insertion plates forms a circular structure, and at this point, the rotation of the rotating disc is restricted from further rotation. The screw rod 10 in the adjusting part 14 is then twisted into the sleeve pipe 12, allowing them to be connected. The adjusting part 14 is adjusted to a proper length before the dumbbell plates 1 are installed. The dumbbell plates 1 are directly inserted into the gripping part 4. Upon completing the insertion, the screwing part 2 is then controlled to tightly attach to the dumbbell plates 1, fixing the dumbbell plates 1. When the number of the dumbbell plates 1 needs to be adjusted, only the screwing part 2 needs to be rotated to extend or shorten the length of the adjusting part 14.

The above description represents only the preferred embodiments of the present invention. However, the protection scope of the present invention is not limited thereto. Equivalent replacements or changes made, within the technical scope disclosed by the present invention, by any of those familiar with the technical field according to the technical solutions and the inventive concepts of the present invention shall fall within the protection scope of the present invention.

What is claimed is:

1. A plug-in weighted dumbbell, comprising a dumbbell bar and dumbbell plates, wherein radial plug-in grooves are formed on each of the dumbbell plates; the dumbbell bar comprises a gripping part and adjusting parts, with the adjusting parts in threaded connection with the gripping part; a screwing part is provided at an end of each of the adjusting parts distal to the gripping part; the dumbbell plates are detachably provided on the adjusting parts through the radial plug-in grooves, and two fixed dumbbell plates are fixedly connected to the gripping part, with the two fixed dumbbell plates being used to limit positions of the dumbbell plates;

wherein the adjusting parts comprise sleeve pipes, and the sleeve pipes are fixedly connected to both ends of the gripping part; a plurality of second insertion plates are provided on an outer wall of each of the sleeve pipes, and a screw rod is internally and threadedly connected to each of the sleeve pipes; an end of each of the screw rods is fixedly connected to the respective screwing part; an end of each of the screw rods adjacent to the screwing parts is a plain shaft, and a plurality of first insertion plates are rotatably provided on the plain shaft; each of the plurality of first insertion plates matches a gap between two adjacent second insertion plates of the plurality of second insertion plates.

2. The plug-in weighted dumbbell according to claim 1, wherein through holes are formed on each of the dumbbell plates, and each of the through holes is detachably provided with a positioning bolt; a nut is provided on the positioning bolt.

3. The plug-in weighted dumbbell according to claim 2, wherein each of the dumbbell plates is provided with at least two of the through holes and at least two of the positioning bolts, and blind holes are formed on each of the two fixed dumbbell plates.

4. The plug-in weighted dumbbell according to claim 1, wherein a plurality of the dumbbell plates are provided on the adjusting parts in a plug-in manner; the screwing parts are used for fixing the dumbbell plates on an outermost side, and the two fixed dumbbell plates are used for fixing the dumbbell plates on an innermost side.

5. The plug-in weighted dumbbell according to claim 1, wherein knurls are formed on the gripping part.

6. The plug-in weighted dumbbell according to claim 1, wherein a carrying hole is formed on each of the dumbbell plates, a convenient removal groove is formed above the carrying hole, and the convenient removal grooves on two adjacent dumbbell plates form a convenient removal hole.

7. The plug-in weighted dumbbell according to claim 1, wherein the plurality of first insertion plates and the plurality of second insertion plates are arc-shaped plates; a first arc-shaped transition is provided at an edge of an end of each of the plurality of first insertion plates distal to the screwing part, and a second arc-shaped transition is provided at an edge of an end of each of the plurality of second insertion plates adjacent to the screwing part.

* * * * *